US009346274B2

(12) United States Patent
Misumi et al.

(10) Patent No.: US 9,346,274 B2
(45) Date of Patent: May 24, 2016

(54) METHOD FOR CLEANING LIQUID EJECTION HEAD

(71) Applicant: CANON KABUSHIKI KAISHA, Tokyo (JP)

(72) Inventors: Yoshinori Misumi, Tokyo (JP); Ichiro Saito, Yokohama (JP); Maki Kato, Fuchu (JP); Yuzuru Ishida, Yokohama (JP); Norihiro Yoshinari, Kawasaki (JP); Akio Goto, Tokyo (JP); Takahiro Matsui, Yokohama (JP); Kenji Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/789,741

(22) Filed: Jul. 1, 2015

(65) Prior Publication Data

US 2016/0001561 A1 Jan. 7, 2016

(30) Foreign Application Priority Data

Jul. 4, 2014 (JP) ..... 2014-138880

(51) Int. Cl.
*B41J 2/165* (2006.01)
*B41J 2/14* (2006.01)

(52) U.S. Cl.
CPC ..... *B41J 2/16517* (2013.01); *B41J 2/14072* (2013.01); *B41J 2/14129* (2013.01)

(58) Field of Classification Search
CPC ..... B41J 2/14072; B41J 2/14129; B41J 2/14233; B41J 2/1603; B41J 2/1629; B41J 2/1642; B41J 2/1628; B41J 2/1631; B41J 2/1641; B41J 2/1621; B41J 2002/14387; B41J 2202/11; B41J 2202/03
See application file for complete search history.

(56) References Cited

U.S. PATENT DOCUMENTS 7,543,908 B2 * 6/2009 Jones ..... B41J 2/14112 347/26
7,950,769 B2 * 5/2011 Sakai ..... B41J 2/14072 347/22

FOREIGN PATENT DOCUMENTS

JP 2008-008364 A 1/2008
JP 2010-137554 A 6/2010

* cited by examiner

*Primary Examiner* — Juanita D Jackson
(74) *Attorney, Agent, or Firm* — Canon USA, Inc. IP Division

(57) ABSTRACT

A method for cleaning a liquid ejection head which includes applying a voltage to a coating layer of the liquid ejection head to cause the coating layer to be eluted in a liquid so that kogation deposited on a coating layer is removed. When removing kogation deposited on the coating layer, temperatures of the liquids in the liquid chambers are selectively changed among a plurality of liquid chambers.

9 Claims, 6 Drawing Sheets

METHOD FOR CLEANING LIQUID EJECTION HEAD

BACKGROUND OF THE INVENTION

1. Field of the Invention

The present invention relates to a method for cleaning a liquid ejection head.

2. Description of the Related Art

A liquid ejection head that ejects a liquid using a heat generating resistive element used, for example, in an inkjet printer is proposed. This liquid ejection head includes a flow path forming member that forms a flow path of a liquid, such as ink, and a heat generating resistive element. The heat generating resistive element is formed, for example, by an electrothermal converting element. When the heat generating resistive element is made to generate heat, the liquid is heated suddenly and foams in a liquid contact area (i.e., a thermal action portion) located above the heat generating resistive element. Foaming produces pressure with which the liquid is ejected from ejection ports. An image is recorded on a surface of a recording medium, such as a paper sheet, with the liquid. To insulate the heat generating resistive element from the liquid, covering the heat generating resistive element with an insulating layer is proposed. The heat generating resistive element receives the following complex actions: physical actions including impact due to cavitation caused by foaming and deaeration of the liquid, and chemical actions caused by the liquid. Therefore, covering the heat generating resistive element with a coating layer for protection is proposed.

In a liquid ejection head, the following phenomenon may occur: an additive, such as a coloring material included in a liquid, is decomposed when heated at a high temperature, the additive changes into a highly insoluble substance, and the additive is physically absorbed into a layer in contact with the liquid, such as an insulating layer and a coating layer. The physically absorbed object is called "kogation." When kogation adheres to the protective layer, uneven heat conduction from a thermal action portion to the liquid may occur, foaming may become unstable, and ejection characteristics of the liquid may be adversely affected.

To address this problem, Japanese Patent Laid-Open No. 2008-8364 and Japanese Patent Laid-Open No. 2010-137554 each disclose a configuration in which an electrically connectable upper protective layer (i.e., a coating layer) is disposed in an area including a thermal action portion to form an electrode that provokes electrochemical reaction with a liquid. These Patent Documents disclose removing kogation by eluting a surface of the upper protective layer by the electrochemical reaction.

SUMMARY OF THE INVENTION

The problems described above are solved by the following present disclosure. A method for cleaning a liquid ejection head that includes a plurality of liquid chambers, a heat generating resistive element configured to generate energy for ejecting a liquid in the liquid chambers, and a coating layer configured to coat the heat generating resistive element, the method including applying a voltage to the coating layer to provoke an electrochemical reaction between the coating layer and the liquid, and causing the coating layer to be eluted into the liquid, thereby removing kogation deposited on the coating layer, wherein when removing kogation deposited on the coating layer, temperatures of the liquids in the liquid chambers are selectively changed among the plurality of liquid chambers.

Further features of the present invention will become apparent from the following description of exemplary embodiments with reference to the attached drawings.

DESCRIPTION OF THE EMBODIMENTS

In the methods for removing kogation by an electrochemical reaction described in Japanese Patent Laid-Open No. 2008-8364 and Japanese Patent Laid-Open No. 2010-137554, kogation is removed collectively in all the liquid chambers under the same condition. This means that upper protective layers are made to elute in the same manner in all the liquid chambers.

When recording is performed with a liquid ejected from ejection ports, however, the number of ejection pulses applied to a heat generating resistive element in each liquid chamber vary depending on the liquid chambers. Therefore, the conditions of kogation also vary depending on the liquid chambers. If kogation is removed in this state by the methods described in Japanese Patent Laid-Open No. 2008-8364 and Japanese Patent Laid-Open No. 2010-137554, upper protective layers to which kogation has not adhered or upper protective layers to which a relatively small amount of kogation has adhered are also made to elute as well as upper protective layers to which a certain amount or more of kogation has adhered.

The present invention provides a method for cleaning a liquid ejection head capable of selectively removing kogation inside a particular liquid chamber if conditions of kogation of heat generating resistive elements of liquid chambers are uneven.

Figure 1:
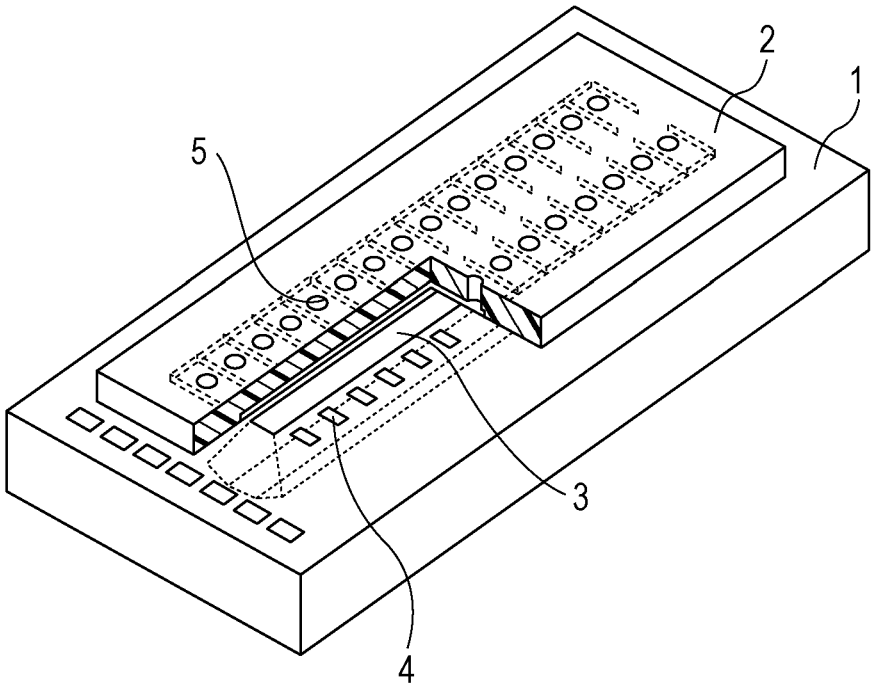
FIG. 1 illustrates a liquid ejection head.

FIG. 1 is a schematic diagram of a liquid ejection head of the present invention. The liquid ejection head includes a substrate 1 and a flow path forming member 2 formed on the substrate 1. The substrate 1 is made, for example, of silicon, and a supply port 3 is formed to penetrate the substrate 1. Heat generating resistive elements 4, which are thermal action portions, are formed on both sides of an opening of the supply port 3. The flow path forming member 2 forms liquid flow paths and liquid chambers, and is made of resin or inorganic film. Ejection ports 5 open in the flow path forming member 2 to face the heat generating resistive elements 4. In FIG. 1, a region (i.e., a room) between the heat generating resistive elements 4 and the ejection ports 5 are the liquid chambers. In FIG. 1, one heat generating resistive element 4 is formed inside one liquid chamber, and the ejection ports 5 open in the flow path forming member 2 to face the heat generating resistive elements 4. A liquid is supplied to the liquid chambers from the supply port 3. Energy for ejection is provided to the liquid by the heat generating resistive elements 4. The liquid is ejected from the ejection ports 5 and lands at a recording medium to carry out recording.

Figure 2A:
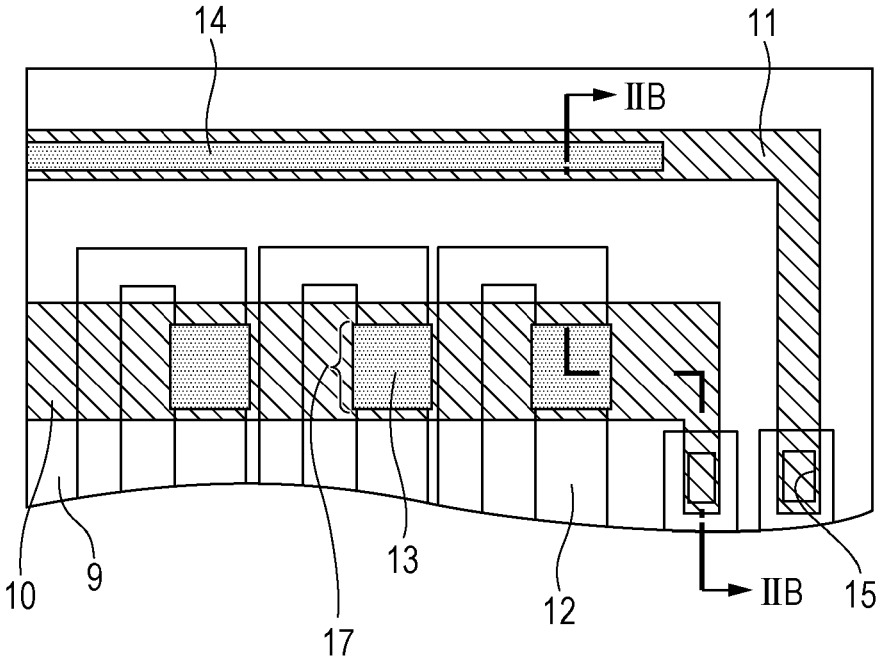
FIGS. 2A and 2B illustrate a liquid ejection head.
Figure 2B:
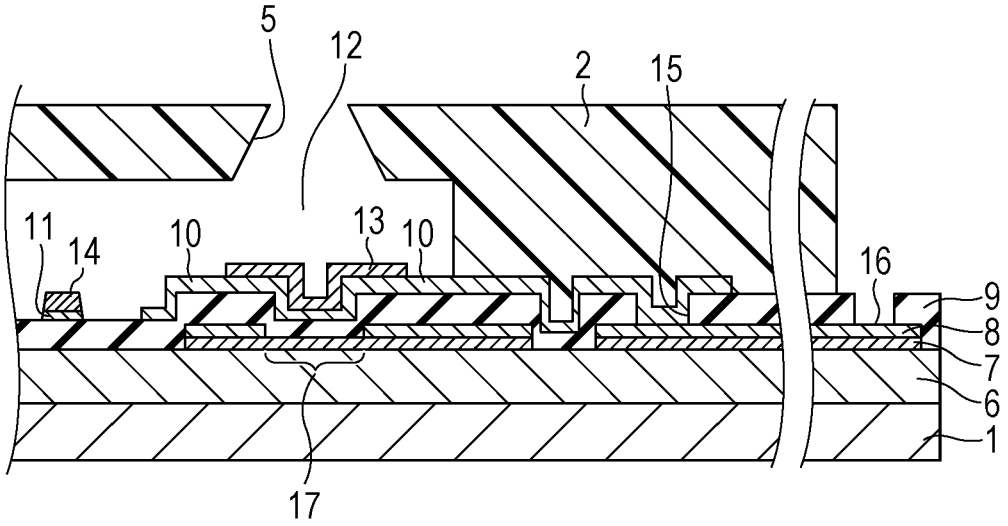

FIG. 2A is a top view of the substrate 1 of the liquid ejection head illustrated in FIG. 1. FIG. 2B is a cross-sectional view along line IIB-IIB in FIG. 2A. A heat accumulation layer 6 made, for example, of $SiO_2$ or SiN is formed on the substrate 1, and a heat generating resistive element layer 7 is formed on the heat accumulation layer 6. A pair of electrode wiring layers 8 made of a metallic material, such as Al, Al—Si, and Al—Cu, is formed on the heat generating resistive element layer 7 with a certain space. A region in which the electrode wiring layer 8 is not provided becomes a thermal action portion 17. The thermal action portion 17 is formed inside the liquid chamber 12, in which heat acts on the liquid to cause ejection. The heat generating resistive element layer 7 at the thermal action portion 17 corresponds to the heat generating resistive elements 4 in FIG. 1.

The heat generating resistive element layer 7 and the electrode wiring layer 8 are covered by a lower protective layer 9. The lower protective layer 9 is made, for example, of $SiO_2$ or SiN, and may function also as an insulating layer. The thermal action portion 17 is constituted by the heat generating resistive element layer 7 at a portion in which the electrode wiring layer 8 is not provided, and the lower protective layer 9 formed on the electrode wiring layer 8. The electrode wiring layer 8 is connected to an unillustrated driving element circuit or an unillustrated external power supply terminal to receive power supply from outside. The heat generating resistive element layer 7 may be on the electrode wiring layer 8 (i.e., may be located distant from the substrate 1) and vice versa.

A first adhesion layer 10 and a second adhesion layer 11 are provided on the lower protective layer 9. The first adhesion layer 10 and the second adhesion layer 11 are made, for example, of Ta. The first adhesion layer 10 is disposed in a region including above the thermal action portion 17, and the second adhesion layer 11 is disposed separated from the first adhesion layer 10 at a portion in contact with the liquid inside the liquid chamber 12. A first coating layer 13 is provided at a portion corresponding to the thermal action portion 17 on the first adhesion layer 10. Desirably, the first coating layer 13 protects the heat generating resistive elements from chemical and physical impacts caused by heating of the liquid, and is eluted during a cleaning process for the removal of kogation. The first coating layer 13 and a second coating layer 14, which is used as a flow-passage electrode, are not electrically connected via the substrate 1. When the liquid chambers 12 are filled with a liquid (e.g., ink) including an electrolyte, a current flows via the liquid. Then, an electrochemical reaction occurs on an interface between the first coating layer 13 and a solution, and an interface between the second coating layer 14 and a solution.

In FIGS. 2A and 2B, a through hole 15 is formed in the lower protective layer 9 to provoke the electrochemical reaction between the first coating layer 13 and the liquid, and the first coating layer 13 and the electrode wiring layer 8 are connected via the first adhesion layer 10. The electrode wiring layer 8 extends to an end portion of the substrate 1 and an end of the electrode wiring layer 8 functions as an external electrode 16 for electrical connection with the outside. The first coating layer 13 corresponding to the thermal action portion 17 is desirably formed not in contact with the flow path forming member 2. This is to reduce a decrease in adhesiveness between the flow path forming member 2 and the lower protective layer 9 or the first adhesion layer 10 when the first coating layer 13 is eluted by an electrochemical reaction.

In the present invention, a voltage is applied to the first coating layer 13 that covers the heat generating resistive elements to provoke an electrochemical reaction, whereby the first coating layer 13 is eluted into the liquid. In this manner, the cleaning process to remove kogation deposited on the first coating layer 13 is performed. Here, when removing kogation deposited on the first coating layer 13, temperatures of the liquid inside the liquid chambers 12 are selectively changed among a plurality of liquid chambers. For example, depending on the deposition condition of kogation on the heat generating resistive elements, the temperature on each heat generating resistive element surface is controlled, and then the cleaning process for the removal of kogation is performed.

Preferably, a deposition condition of kogation on the first coating layer 13 on the heat generating resistive elements is checked periodically. With this configuration, the deposition condition of kogation on each heat generating resistive element is checked, and if it is determined that a deposition amount of kogation is large, the cleaning process can be performed at a higher temperature.

Desirably, removal of kogation in the present invention is not performed immediately after ejection of the liquid for recording. The reason is as follows: there is a possibility that, immediately after ejection of the liquid for recording, the temperature of the liquid in the liquid chambers from which the liquid has been ejected is increased by the heat generating resistive elements. Kogation is removed desirably after 30 seconds or more, and more desirably after one minute or more, since the liquid is ejected for recording.

Figure 3:
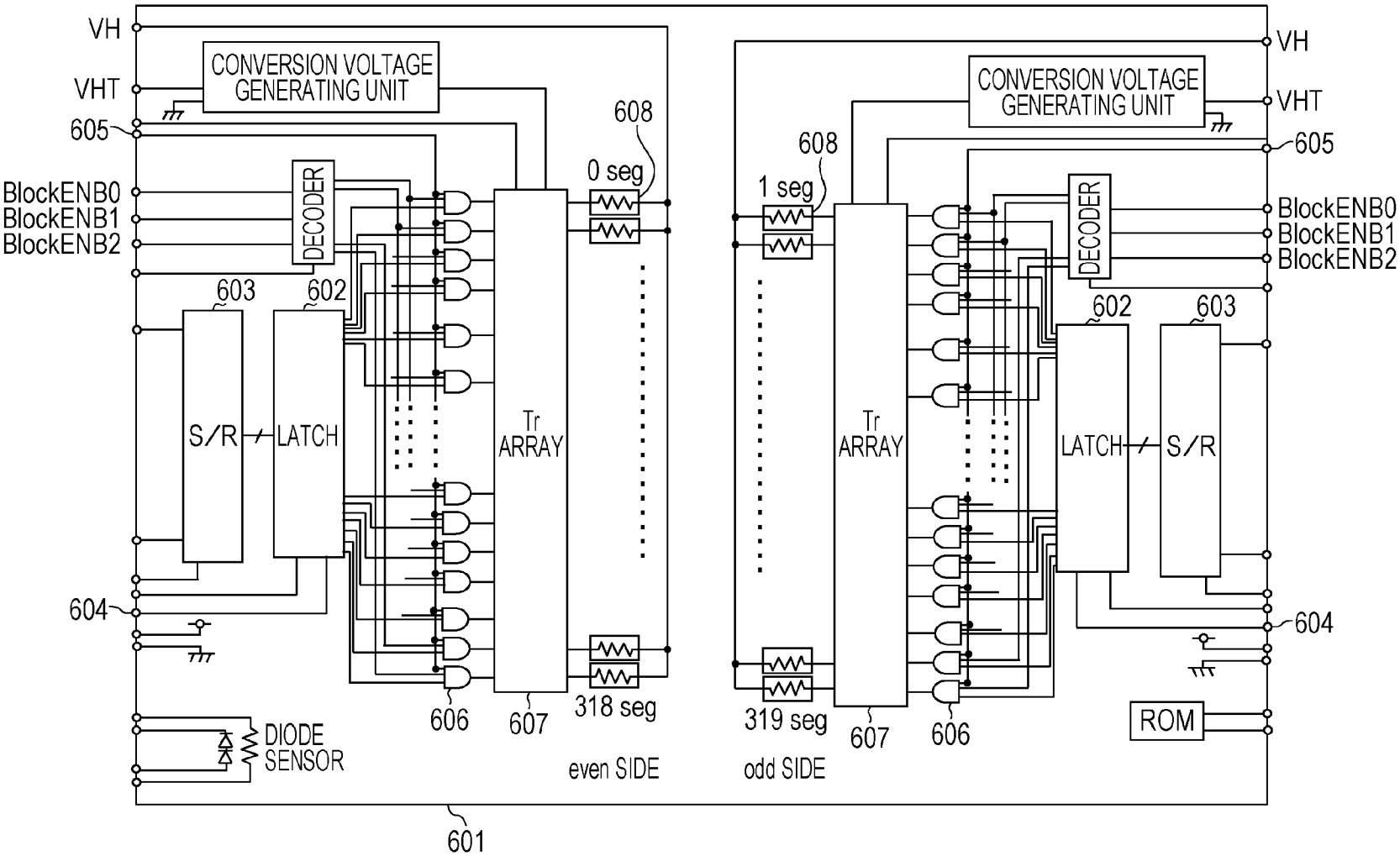
FIG. 3 is a circuit configuration diagram of a liquid ejection head.

FIG. 3 is a circuit diagram illustrating a circuit configuration of a liquid ejection head. The reference numeral 601 denotes a substrate of the liquid ejection head and 602 denotes a latch circuit for latching recording data. 603 denotes a shift register that serially inputs the recording data in synchronization with a shift clock, and holds the data. 604 denotes an input terminal of latch signals for latching recording data input from a control unit of a liquid ejection recording apparatus of the present embodiment. 605 denotes an input terminal of heat pulse signals. The latch circuit 602 and the shift register 603 are mounted on the substrate 601. The shift register 603 serially inputs and holds later-described selection data stored in ROM. The latch circuit 602 latches the selection data. 606 denotes an AND circuit. When an output of the AND circuit 606 that obtains a logical sum of the heat pulse signals, the recording data signals, block signals, and selection data is set to a high level, a transistor for driving the heat generating resistive element in a transistor array 607 corresponding to that AND circuit 606 is turned ON, a current flows in the heat generating resistive element 608 connected to the transistor, and the heat generating resistive element 608 is driven to generate heat. A connecting relationship among the heat generating resistive element 608, the transistor, and the AND circuit 606 is described later.

Next, an operation of a printing apparatus using the thus-configured liquid ejection head is schematically described. First, after the apparatus is powered on, depending on a liquid foaming level in each substrate 601 measured in advance, a pulse width of a heat pulse applied to each heat generating resistive element is determined. The liquid foaming level is based on ranks of the minimum liquid ejection pulse value when a predetermined voltage is applied under constant temperature conditions. The heat pulse includes a preheat pulse and a main heat pulse. The determined width data of the heat pulse corresponding to each ejection port is transferred to the shift register 603 in synchronization with the shift clock. Then, voltage signals are output. When the heat generating resistive element is energized, according to the selection data stored in the ROM, the driving condition of the heat generating resistive element 608 is selected as described later. The selection data stored in the ROM is latched by the latch circuit 602. It is only necessary to latch the selection data only once at the time, for example, of start-up of the printing apparatus.

Next, generation of the heat pulse signals after the selection data is stored in the ROM is described. First, signals from the ROM are fed back, and a pulse width of the heat pulse is determined so that energy suitable for the liquid ejection is applied to the heat generating resistive element 608 in accordance with pulse data selected by the signals. A pulse width and application timing of a preheat pulse are determined by a printer control unit in accordance with detected values of a temperature sensor. Various heat pulses may be set so that the ejection amount of the liquid is kept constant in each liquid chamber under various temperature conditions.

Figure 4:
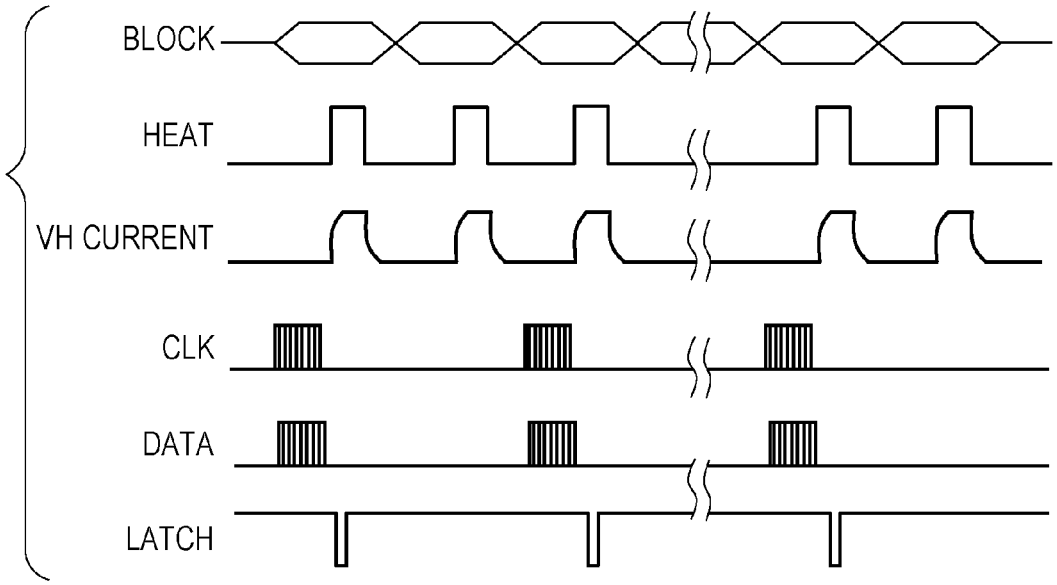
FIG. 4 is a driving timing diagram of a liquid ejection head.

FIG. 4 is a timing chart illustrating driving of liquid ejection. The latch that temporarily holds recorded information is a shift register that inputs recorded information (DATA) serially supplied from the input terminal in accordance with a transfer clock (CLK) supplied from the input terminal, and outputs the recorded information (DATA) to the latch in parallel. In the liquid ejection head, the shift register is connected to the latch, and the output of the shift register is held by the latch at a certain time. A plurality of heat generating resistive elements are divided into a plurality of groups. A heat selection circuit that selects a particular group in accordance with a block enable signal supplied from the input terminal and drives the heat generating resistive element is provided. A logical sum of the heat pulse output from the AND circuit in accordance with the recording data and the signals selected and output by the selection circuit is obtained and output to a driver. When the output signal is thus set to a high level, a corresponding driver is turned ON, a current flows through the heat generating resistive element connected to the driver to drive the heat generating resistive element to generate heat, and liquid droplets are ejected from the ejection ports by means of film boiling of the liquid in the liquid chambers, whereby recording is performed on the recording medium.

FIGS. 5A to 5H are diagrams illustrating a method for manufacturing a liquid ejection head. FIGS. 6A to 6H are top views of the liquid ejection head each corresponding to FIGS. 5A to 5H.

The manufacturing processes described below is performed to a substrate on which a driving circuit constituted by a semiconductor device, such as a switching transistor, for selectively driving the heat generating resistive element is mounted in advance. For the ease of description, the substrate 1 made of silicon is illustrated in the drawings.

First, the heat accumulation layer 6 is formed on the substrate 1 as an underlayer of the heat generating resistive element layer by, for example, thermal oxidation, spattering, and CVD. The heat accumulation layer can be formed on the substrate on which the driving circuits are mounted in advance, during the manufacturing process of the driving circuits.

Figure 5A:
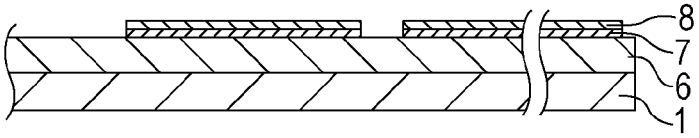
FIGS. 5A to 5H are diagrams illustrating a method for manufacturing a liquid ejection head.
Figure 6A:
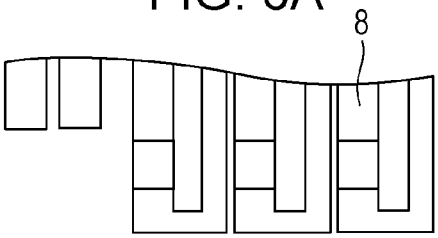
FIGS. 6A to 6H are diagrams illustrating a method for manufacturing a liquid ejection head.

Next, the heat generating resistive element layer made, for example, of TaSiN is formed on the heat accumulation layer 6 by, for example, sputtering and then the electrode wiring layer 8 made, for example, of Al is formed, for example, by sputtering. A thickness of the heat generating resistive element layer 7 is desirably equal to or greater than 300 nm to equal to or less than 700 nm. A thickness of the electrode wiring layer 8 is desirably equal to or greater than 100 nm to equal to or less than 500 nm. Then, the heat generating resistive element layer 7 and the electrode wiring layer 8 are simultaneously subject to etching, such as reactive ion etching, by photolithography to form the shape as illustrated in FIGS. 5A and 6A.

Figure 5B:
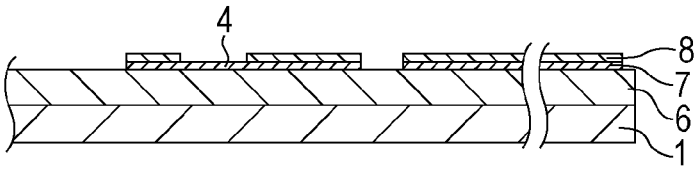
Figure 6B:
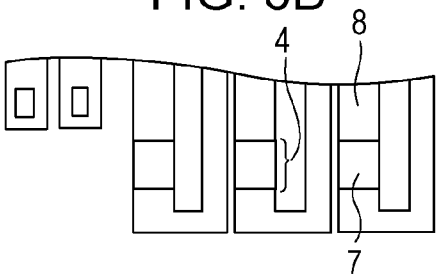

Next, as illustrated in FIGS. 5B and 6B, the electrode wiring layer 8 is partially removed by wet etching, and the heat generating resistive element layer 7 at the removed portion is exposed. The exposed portion of the heat generating resistive element layer is the thermal action portion, which becomes the heat generating resistive element. To keep the coverage of the lower protective layer 9 at a wiring end portion favorable, it is desirable to perform publicly known wet etching that provides a suitable tapered form at the wiring end portion.

Figure 5C:
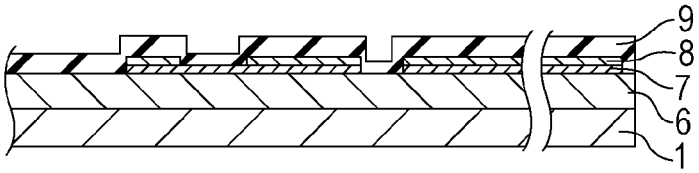
Figure 6C:
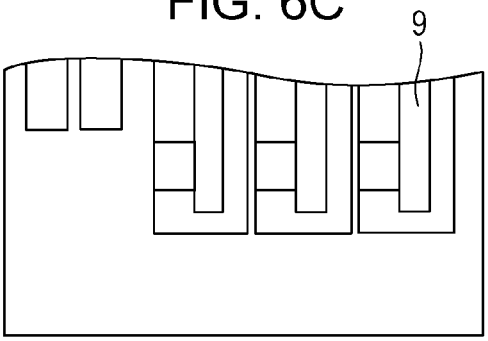

Next, the lower protective layer 9 made, for example, of SiN, is formed by, for example, plasma CVD as illustrated in FIGS. 5C and 6C and the thermal action portion 17 is provided. A thickness of the lower protective layer 9 is desirably equal to or greater than 150 nm to equal to or less than 550 nm.

Figure 5D:
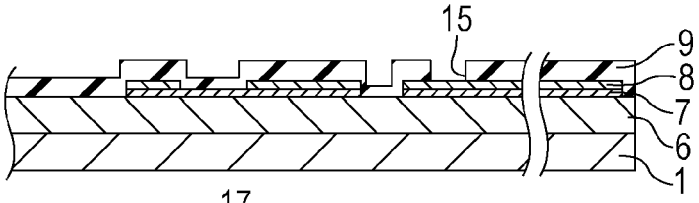
Figure 6D:
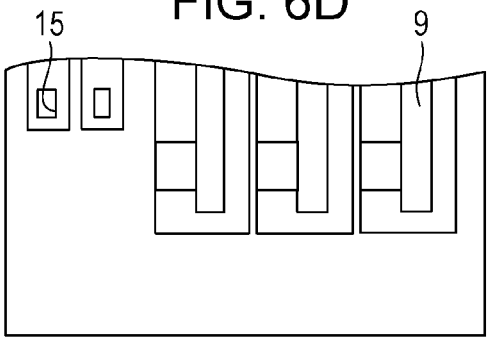

Next, as illustrated in FIGS. 5D and 6D, the lower protective layer 9 is removed partially by dry etching, using, for example, photolithography, and the through hole 15 is formed. The through hole 15 electrically connects the first adhesion layer 10 and the first coating layer 13 formed on the upper layer of the lower protective layer 9, and the electrode wiring layer 8, whereby the electrode wiring layer 8 is exposed.

Figure 5E:
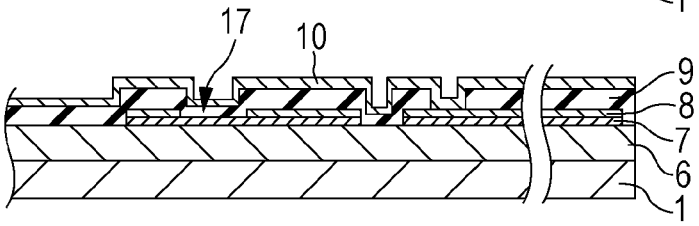
Figure 6E:
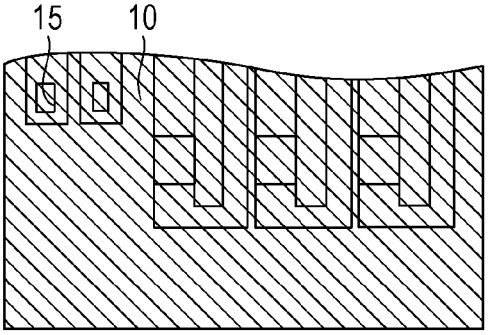

Next, as illustrated in FIGS. 5E and 6E, the first adhesion layer 10 also functioning as a wiring layer that supplies power to the first coating layer 13 during the electrochemical reaction is formed by, for example, sputtering tantalum on the lower protective layer 9. A thickness of the first adhesion layer 10 is desirably equal to or greater than 50 nm to equal to or less than 150 nm.

Figure 5F:
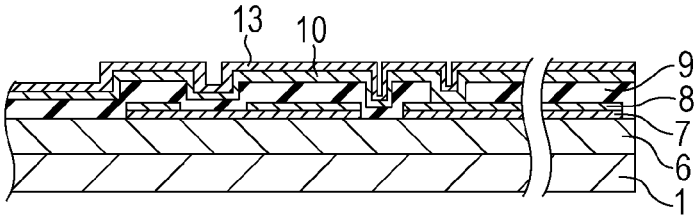
Figure 6F:
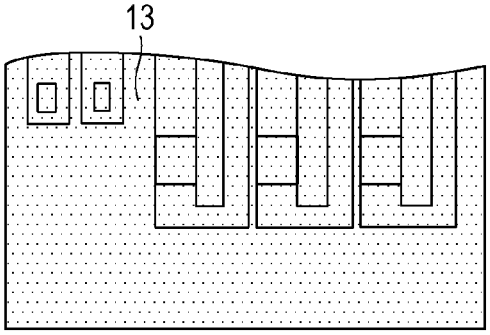

Next, as illustrated in FIGS. 5F and 6F, the first coating layer 13 is formed. The first coating layer desirably has a laminated structure constituted by alternately laminated two or more upper layers and lower layers. For example, an Ir layer is first formed by spattering as the upper layer on the upper surface of the first adhesion layer 10. Then, the lower layer is formed by spattering in the similar manner. In this series of processes, the first coating layer 13 in which the upper layer and the lower layer are laminated is formed. A thickness of the upper layer is desirably equal to or greater than 10 nm to equal to or less than 50 nm. A thickness of the lower layer is desirably equal to or greater than 50 nm to equal to or less than 200 nm.

Figure 5G:
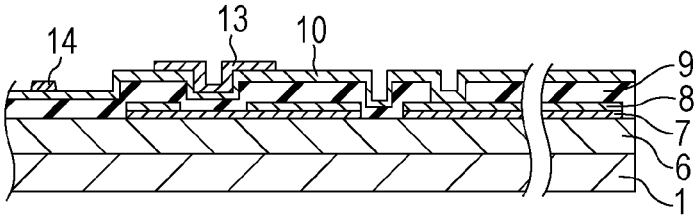
Figure 6G:
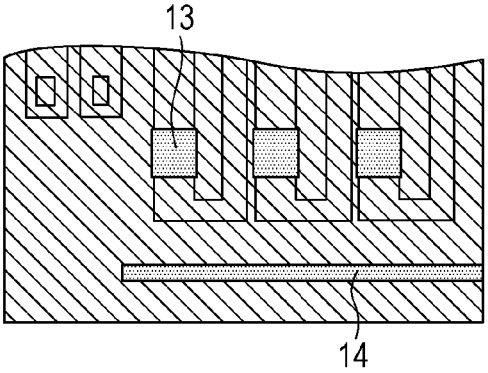

Next, a pattern of the first coating layer 13 as illustrated in FIGS. 5G and 6G is formed. The first coating layer 13 is removed partially by reactive ion etching using photolithography. The first coating layer 13 on the thermal action portion 17 and the second coating layer 14 are thus formed.

Figure 5H:
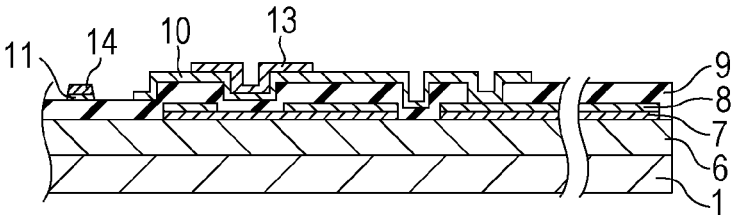
Figure 6H:
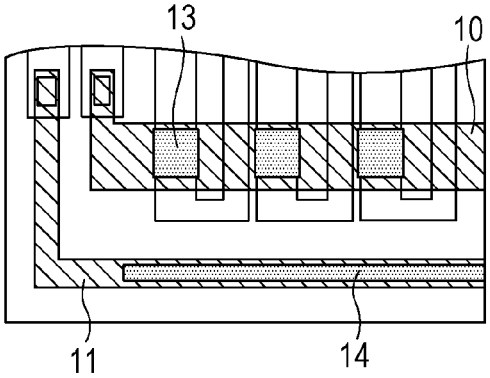

Next, to form a pattern of the first adhesion layer 10 as illustrated in FIGS. 5H and 6H, the first adhesion layer 10 is removed partially by dry etching using photolithography. The first adhesion layer 10 on the thermal action portion 17 and the second adhesion layer 11 are thus formed.

Next, to form the external electrode 16, the lower protective layer 9 is removed partially by reactive ion etching using photolithography, and the electrode wiring layer 8 of that portion is exposed partially (not illustrated).

The flow path forming member is formed by, for example, photolithography on the substrate for the liquid ejection head manufactured in the process described above, a supply port is formed on the substrate, and the like, whereby the liquid ejection head is completed.

A method for performing the cleaning process to remove kogation in the liquid ejection head of the present invention is described. In the cleaning process to remove kogation of the present invention, the first coating layer 13 corresponding to the thermal action portion is used as an anode electrode and the second coating layer 14 (i.e., the flow-passage electrode) is used as a cathode electrode, and an electrochemical reaction with the liquid that is a solution including an electrolyte is provoked. Since the first coating layer 13 is connected to the external electrode 16 via the first adhesion layer 10 and the electrode wiring layer 8, it is only necessary to apply a voltage so that the first coating layer 13 is used as an anode electrode. A surface portion (in a multilayer structure, the uppermost layer) of the first coating layer that is the anode electrode is eluted, and kogation deposited on the first coating layer 13 is removed. Metallic materials eluted into the solution by the electrochemical reaction can be generally known with reference to potential-pH diagrams of various metals. Desirably, the material used for a protective layer of the first coating layer 13 is not eluted at a pH value of a liquid, but eluted when the first coating layer 13 becomes an anode electrode upon application of a voltage. That is, the first coating layer 13 is made of metal eluted by the electrochemical reaction in the liquid. The metal is, for example, Ir and Ru. The second coating layer 14, which is a counter electrode, is desirably made of Ir and Ru, similarly. More desirably, the first coating layer 13 and the second coating layer 14 are made of the same kind of metal.

When the first coating layer 13 is eluted, kogation deposited on the first coating layer 13 can be eluted together. The outermost surface of the first coating layer 13 is desirably made of Ir. This is because, in the second coating layer 14 used as the cathode electrode, if the uppermost layer is made of Ir, the upper layer is less easily oxidized during ejection and stability as the cathode electrode can be kept. The second coating layer 14 connected to the cathode side does not necessarily have to have a laminated structure, but desirably has the same layer configuration as that of the first coating layer 13 when the manufacturing processes, such as film formation and etching, are considered.

Hereinafter, an example in which an actual pattern is recorded (i.e., printed) and the cleaning process to remove kogation is performed is illustrated in detail. When 830 sheets of a pattern including images and characters are printed, $1\times10^9$ pulses are applied to a liquid chamber a, $2\times10^8$ pulses are applied to a liquid chamber b, and $8\times10^7$ pulses are applied to a liquid chamber c. Since the number of applied pulses is large in the liquid chamber a, amount of deposited kogation is greater in the liquid chamber a than in the liquid chambers b and c. Since the deposition amount of kogation is large in the liquid chamber a, the minimum foaming energy (Pth) increases by 12% or more compared with the initial state, and an ejection speed decreases by about 20% compared with the initial state. Since the deposition amount of kogation in the liquid chambers b and c is small, there is no large change in Pth and in ejection speed compared with the initial state. At this time, only the liquid chamber a is subject to the cleaning process to remove kogation. When 1200 sheets of a pattern constituted mainly of characters are printed, $3\times10^8$ pulses are applied to the liquid chamber a, $1\times10^9$ pulses are applied to the liquid chamber b, and $6\times10^7$ pulses are applied to the liquid chamber c. Since the deposition amount of kogation is large in the liquid chamber b, Pth increases by 12% or more compared with the initial state, and the ejection speed decreases about 20% compared with the initial state. At this time, only the liquid chamber b is subject to the cleaning process to remove kogation. The degree of deposition of kogation in each liquid chamber varies depending on the print pattern or the number of sheets printed. Therefore, as the number of applied pulses to each liquid chamber increases (e.g., $1\times10^9$ pulses), it is determined that the amount of deposition of kogation of that liquid chamber has increased, and only that liquid chamber is subject to the cleaning process to remove kogation. Alternatively, Pth is suitably measured during the printing and, if Pth becomes large compared with the initial state (e.g., 10% or more), it is determined that the deposition amount of kogation on the coating layer on the heat generating resistive element of that liquid chamber has increased, and only that liquid chamber is subject to the cleaning process to remove kogation.

It is desirable that the deposition condition of kogation in each liquid chamber is periodically checked in the present invention. The deposition condition of kogation is checked by periodically measuring Pth of each liquid chamber depending on the number of sheets printed or number of ejection pulses. That is, a threshold of the pulse width for the ejection is checked while shortening the driving pulse width stepwise. Since a Pth measuring unit is provided in the apparatus, the deposition condition of kogation on each heat generating resistive element can be checked, and the temperature of only the heat generating resistive element in the liquid chamber in which the amount of deposition of kogation is large can be controlled before the removal of kogation.

The temperature of each liquid chamber can be controlled in accordance with a liquid ejection history (e.g., a pulse count). Alternatively, the temperature of each liquid chamber can be controlled depending on the change of Pth in accordance with the minimum foaming energy (Pth) in each liquid chamber. Further, the temperature of each liquid chamber can be controlled in accordance with the minimum foaming voltage (Vth) of each liquid chamber, the liquid ejection speed from the ejection port of each liquid chamber, and an observation result (sensory evaluation) of kogation state of each liquid chamber.

The temperature of the liquid chamber is controlled through short pulse heating or ejection pulse heating. Alternatively, a voltage may be applied to the heat generating resistive element in each liquid chamber from a power supply provided separately from the power supply for driving liquid ejection, or the temperature of each liquid chamber may be controlled separately by a heat generating resistive element for temperature control provided in each liquid chamber.

A method for selectively changing the temperature of the liquid in the liquid chamber by providing the heat generating resistive element with pulses indicating not to eject the liquid in the liquid chamber is the method by short pulse driving. When temperature control of the liquid chamber is performed by short pulse driving, the particular liquid chamber for which temperature control has been performed can be subject to the cleaning process to remove kogation. If temperature control is not performed, the temperature in the liquid chamber increases very little, and no electrochemical reaction between the liquid (i.e., ink) in the liquid chamber and the first coating layer 13 is provoked. Therefore, the cleaning process to remove kogation is not sufficiently performed, but it becomes possible to remove kogation of a desired liquid chamber by performing temperature control of the particular liquid chamber.

As an alternative method, the temperature of the liquid in the liquid chamber may be changed selectively by providing the heat generating resistive element with pulses for the ejection of the liquid in the liquid chamber. When the degrees of deposition of kogation vary depending on the liquid chambers, by selecting the liquid chamber in which a larger amount of kogation is deposited and causing the liquid to be ejected by pulse driving, only the particular liquid chamber from which the liquid is ejected can be subject to the cleaning process to remove kogation. If ejection is not performed, the temperature in the liquid chamber increases very little, and no electrochemical reaction between the liquid (i.e., ink) in the liquid chamber and the first coating layer 13 is provoked. Therefore, the cleaning process to remove kogation is not sufficiently performed, but it becomes possible to remove kogation of a desired liquid chamber by performing selective ejection from the particular liquid chamber.

EXAMPLES

Example 1

A cleaning process to remove kogation is performed using the liquid ejection head of the present invention.

As the layers on the thermal action portion 17 in the liquid ejection head, after forming a Ta layer as the first adhesion layer 10, an Ir layer is formed as the first coating layer 13. After driving the thermal action portion under a predetermined condition so that kogation deposits on the first coating layer 13 corresponding to the thermal action portion 17, a cleaning process to remove kogation is performed by energizing the first coating layer 13. Cyan ink (trade name: BCI-7eC manufactured by CANON KABUSHIKI KAISHA) is used as the liquid.

First, $1.0\times10^9$ driving pulses at a voltage of 24 V, a pulse width of 0.82 μs, and a frequency of 15 kHz are applied to the thermal action portion 17 of the liquid chamber 12. Then, a surface state of the first coating layer 13 corresponding to the thermal action portion 17 is observed under a microscope, and a large amount of kogation is found to be deposited. The liquid is ejected using the liquid ejection head in this state, and it is observed that droplet landing positions are displaced significantly from desired positions. The ejection speed at this time is 9 m/s while the initial ejection speed is 15 m/s. That is, the ejection speed has decreased by 6 m/s.

Next, a DC voltage of 3.2 V is applied to the external electrode 16 connected to the first coating layer 13 for 30 seconds, and the cleaning process to remove kogation is performed. The first coating layer 13 is used as the anode electrode (positive potential) and the second coating layer 14 is used as the cathode electrode (negative potential). Cleaning for the removal of kogation is performed while controlling the temperature of the liquid chamber 12. The temperature control is performed by applying short pulses indicating not to eject the liquid from the ejection port (i.e., by short pulse driving). Short pulse driving is performed at a voltage of 24 V, a pulse width of 0.45 μs, and a frequency of 12 kHz, the temperature control of the heat generating resistive element is performed in this manner, and the temperature control of the liquid chamber is also performed. A surface temperature of the heat generating resistive element when the short pulses are being applied is measured using an infrared thermoviewer, and it is observed that the surface temperature is from a base temperature of 65 degrees centigrade to the highest temperature of 220 degrees centigrade.

Then, a surface state of the first coating layer 13 is observed under the microscope, and it is observed that the deposited kogation has been removed. The ejection speed is 15 m/s, indicating that the ejection speed has recovered to substantially the same level as that of the initial ejection speed. The dots land desired positions to provide favorable print quality.

The same effects have been obtained about inks of other colors in addition to BCI-7eC, which is the cyan ink.

Example 2

A cleaning process to remove kogation is performed in the same manner as in Example 1 except for the following changes.

Driving pulses at a voltage of 24 V, a pulse width of 0.82 μs, and a frequency of 15 kHz are applied to the thermal action portion 17 of the liquid chamber 12. The liquid is ejected until Pth becomes as follows: the driving voltage is 21.0 V and the pulse width is 0.88 μs or greater. Then, a surface state of the first coating layer corresponding to the thermal action portion 17 is observed under a microscope, and a large amount of kogation is found to be deposited. The liquid is ejected using the liquid ejection head in this state, and it is observed that droplet landing positions are displaced significantly from desired positions. The ejection speed at this time is 9 m/s while the initial ejection speed is 15 m/s. That is, the ejection speed has decreased by 6 m/s.

Next, driving pulses at a voltage of 24 V, a pulse width of 0.82 μs, and a frequency of 15 kHz are applied to the thermal action portion 17 of the liquid chamber 12 on. The cleaning process to remove kogation is performed while ejecting the liquid. As the cleaning process to remove kogation, a DC voltage of 3.2 V is applied to the external electrode 16 connected to the first coating layer 13 for 30 seconds. A surface temperature of the heat generating resistive element when the ejection pulses are being applied is measured using an infrared thermoviewer, and it is observed that the highest temperature is equal to or higher than 300 degrees centigrade.

Then, the portion at which kogation had deposited is observed under the microscope, and it is observed that the deposited kogation has been removed. The ejection speed is 15 m/s, indicating that the ejection speed has recovered to substantially the same level as that of the initial ejection speed. The dots land desired positions to provide favorable print quality.

The same effects have been obtained about inks of other colors in addition to BCI-7eC, which is the cyan ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-138880, filed Jul. 4, 2014, which is hereby incorporated by reference herein in its entirety.

What is claimed is:

1. A method for cleaning a liquid ejection head that includes a plurality of liquid chambers, a heat generating resistive element configured to generate energy for ejecting a liquid in the plurality of liquid chambers, and a coating layer configured to coat the heat generating resistive element, the method including:

applying a voltage to the coating layer to provoke an electrochemical reaction between the coating layer and the liquid, and causing the coating layer to be eluted into the liquid, thereby removing kogation deposited on the coating layer, wherein, when removing kogation deposited on the coating layer, temperatures of liquids in the plurality of liquid chambers are selectively changed among the plurality of liquid chambers depending on a deposition condition of the kogation on the coating layer.

2. The method according to claim 1, wherein the temperatures of the liquids are selectively changed by providing the heat generating resistive element with pulses indicating not to eject the liquid in a liquid chamber.

3. The method according to claim 1, wherein the temperatures of the liquids are selectively changed by providing the heat generating resistive element with pulses indicating to eject the liquid in a liquid chamber.

4. The method according to claim 1, wherein the temperatures of the liquids are selectively changed in accordance with a liquid ejection history of each liquid chamber of the plurality of liquid chambers.

5. The method according to claim 1, wherein the temperatures of the liquids are selectively changed in accordance with a minimum foaming energy of each liquid chamber of the plurality of liquid chambers.

6. The method according to claim 1, wherein the temperatures of the liquids are selectively changed in accordance with a minimum foaming voltage of each liquid chamber of the plurality of liquid chambers.

7. The method according to claim 1, wherein the temperatures of the liquids are selectively changed in accordance with a liquid ejection speed from ejection ports of each liquid chamber of the plurality of liquid chambers.

8. The method according to claim 1, wherein the coating layer is made of Iridium (Ir) or Ruthenium (Ru).

9. The method according to claim 1, wherein the liquid ejection head further includes a plurality of heat generating resistive elements and a plurality of coating layers, each of which is configured to coat the heat generating resistive element, wherein applying includes applying a voltage to the plurality of coating layers to remove the kogation.

* * * * *